US011208844B2

(12) United States Patent
Ross

(10) Patent No.: US 11,208,844 B2
(45) Date of Patent: Dec. 28, 2021

(54) LADDER ROLLER AND PULLEY SYSTEM AND METHOD OF USE

(71) Applicant: Mark D. Ross, Merriam, KS (US)

(72) Inventor: Mark D. Ross, Merriam, KS (US)

( * ) Notice: Subject to any disclaimer, the term of this patent is extended or adjusted under 35 U.S.C. 154(b) by 92 days.

(21) Appl. No.: 16/501,484

(22) Filed: Aug. 8, 2019

(65) Prior Publication Data

US 2020/0300039 A1 Sep. 24, 2020

Related U.S. Application Data

(60) Provisional application No. 62/716,272, filed on Aug. 8, 2018.

(51) Int. Cl.
*E06C 1/397* (2006.01)

(52) U.S. Cl.
CPC ..... *E06C 1/397* (2013.01)

(58) Field of Classification Search
CPC ..... E06C 1/393; E06C 7/143
USPC ..... 182/64.1
See application file for complete search history.

(56) References Cited

U.S. PATENT DOCUMENTS 3,353,778 A * 11/1967 Sylvain ..... E06C 7/14 248/211
3,954,155 A * 5/1976 Guidara ..... E06C 1/20 182/20
4,032,100 A * 6/1977 Kahn ..... E06C 7/14 248/211
4,036,463 A * 7/1977 Hopkins ..... B44D 3/123 248/210
4,494,626 A * 1/1985 Ast ..... B62B 1/10 182/106
4,934,485 A * 6/1990 Purkapile ..... E06C 1/005 182/104
5,584,357 A * 12/1996 Gugel ..... B25H 3/06 182/129
5,924,523 A * 7/1999 Krause ..... E06C 1/12 182/211
6,039,149 A * 3/2000 Bedja ..... B62B 1/12 182/165
6,158,749 A * 12/2000 Roudebush ..... B62B 1/12 182/16
6,179,087 B1 * 1/2001 Moffat ..... E06C 1/39 182/15
6,328,330 B1 * 12/2001 Haaser ..... B62B 1/20 182/21
6,880,794 B1 * 4/2005 Kahn ..... A45F 5/02 24/115 R
6,880,835 B2 * 4/2005 Tornabene ..... E06C 1/393 280/30

(Continued)

*Primary Examiner* — Alvin C Chin-Shue
*Assistant Examiner* — Shiref M Mekhaeil
(74) *Attorney, Agent, or Firm* — Law Office of Mark Brown, LLC; Christopher M. DeBacker

(57) ABSTRACT

A mountable roller device for ladders. It is capable of integrating and attaching to step ladders, extension ladders, or most other standard ladders. The mountable roller device has a pair of side latches for connecting to the legs of the ladder, and also includes a plug for inserting into the void within the ladder steps of a typical ladder. Once affixed to the ladder, the ladder can be tipped and rolled along the roller wheel of the device. The roller wheel includes a groove to allow the device to be used as a pulley system with the ladder.

8 Claims, 9 Drawing Sheets

(56) References Cited

U.S. PATENT DOCUMENTS 7,588,255 B2 * 9/2009 Katz ..... A47B 3/08 280/47.18
D721,825 S * 1/2015 Green ..... D25/68
D722,181 S * 2/2015 Green ..... D25/64
10,100,575 B1 * 10/2018 Neubauer ..... E06C 1/10
10,138,679 B2 * 11/2018 Russell ..... E06C 1/393
10,145,176 B2 * 12/2018 Moss ..... E06C 7/185
10,745,968 B2 * 8/2020 Moss ..... E06C 7/182
2002/0112918 A1 * 8/2002 Frketic ..... E06C 1/397 182/16
2002/0117821 A1 * 8/2002 Abraham ..... E06C 7/42 280/79.7
2004/0200667 A1 * 10/2004 Babkes ..... B62B 3/102 182/20
2006/0225954 A1 * 10/2006 Sayles ..... E06C 1/397 182/20
2007/0029138 A1 * 2/2007 Howe ..... E06C 1/393 182/107
2007/0056797 A1 * 3/2007 Wang ..... E06C 1/397 182/21
2007/0277350 A1 * 12/2007 Hines ..... B60B 33/04 16/35 R
2008/0121462 A1 * 5/2008 Pucek ..... E06C 1/397 182/12
2011/0057079 A1 * 3/2011 Reusser ..... E06C 7/143 248/210
2011/0124476 A1 * 5/2011 Holley ..... A63B 23/02 482/121
2012/0211305 A1 * 8/2012 Moss ..... E06C 1/22 182/106
2014/0138496 A1 * 5/2014 Jones ..... G02B 6/483 248/70
2015/0091267 A1 * 4/2015 Conner ..... B62B 9/20 280/47.315
2015/0252617 A1 * 9/2015 Price ..... E06C 1/397 182/106
2016/0024844 A1 * 1/2016 Neubauer ..... E06C 1/38 182/106
2016/0053538 A1 * 2/2016 Wallther ..... E06C 1/397 182/113
2016/0245020 A1 * 8/2016 Lanzafame ..... E06C 1/12
2016/0297064 A1 * 10/2016 Mallinger ..... B25H 1/04
2016/0355204 A1 * 12/2016 Spruth ..... B62B 1/262
2018/0044987 A1 * 2/2018 Lanzafame ..... E06C 1/12
2019/0145170 A1 * 5/2019 Clark ..... E06C 7/46 182/104
2019/0177987 A1 * 6/2019 Neubauer ..... E06C 1/393
2020/0063491 A1 * 2/2020 Green ..... E06C 7/182

* cited by examiner

LADDER ROLLER AND PULLEY SYSTEM AND METHOD OF USE

CROSS-REFERENCE TO RELATED APPLICATION

This application claims priority in U.S. Provisional Patent Application No. 62/716,272 Filed Aug. 8, 2018, which is incorporated herein by reference.

BACKGROUND OF THE INVENTION

1. Field of the Invention

The present invention relates generally to a ladder system and method for use thereof, and more specifically to a mountable roller element for engaging with ladders for easier mobility and providing pulley system.

2. Description of the Related Art

Ladders are a common tool nearly everyone must use at some point in their lives. Some professions rely on ladders on a daily basis. Moving ladders from storage, trucks, or about work sites can be difficult due to their awkward shape and weight. What is needed is a device to simplify the movement of ladders as needed.

Heretofore there has not been available a system or method for a ladder mobility system with the advantages and features of the present invention.

BRIEF SUMMARY OF THE INVENTION

The present invention generally provides a mountable roller device for ladders. It is capable of integrating and attaching to step ladders, extension ladders, or most other standard ladders. The mountable roller device has a pair of side latches for connecting to the legs of the ladder, and also includes a plug for inserting into the void within the ladder steps of a typical ladder. Once affixed to the ladder, the ladder can be tipped and rolled along the roller wheel of the device.

The device can also be used as an integrated pulley system by using a cord or rope and linking it through a groove on the roller wheel. A pair or more of the roller devices can be used to make a more complex pulley system. This can be used to transport materials or tools using the ladder.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Ladder Roller System 2

Figure 12:
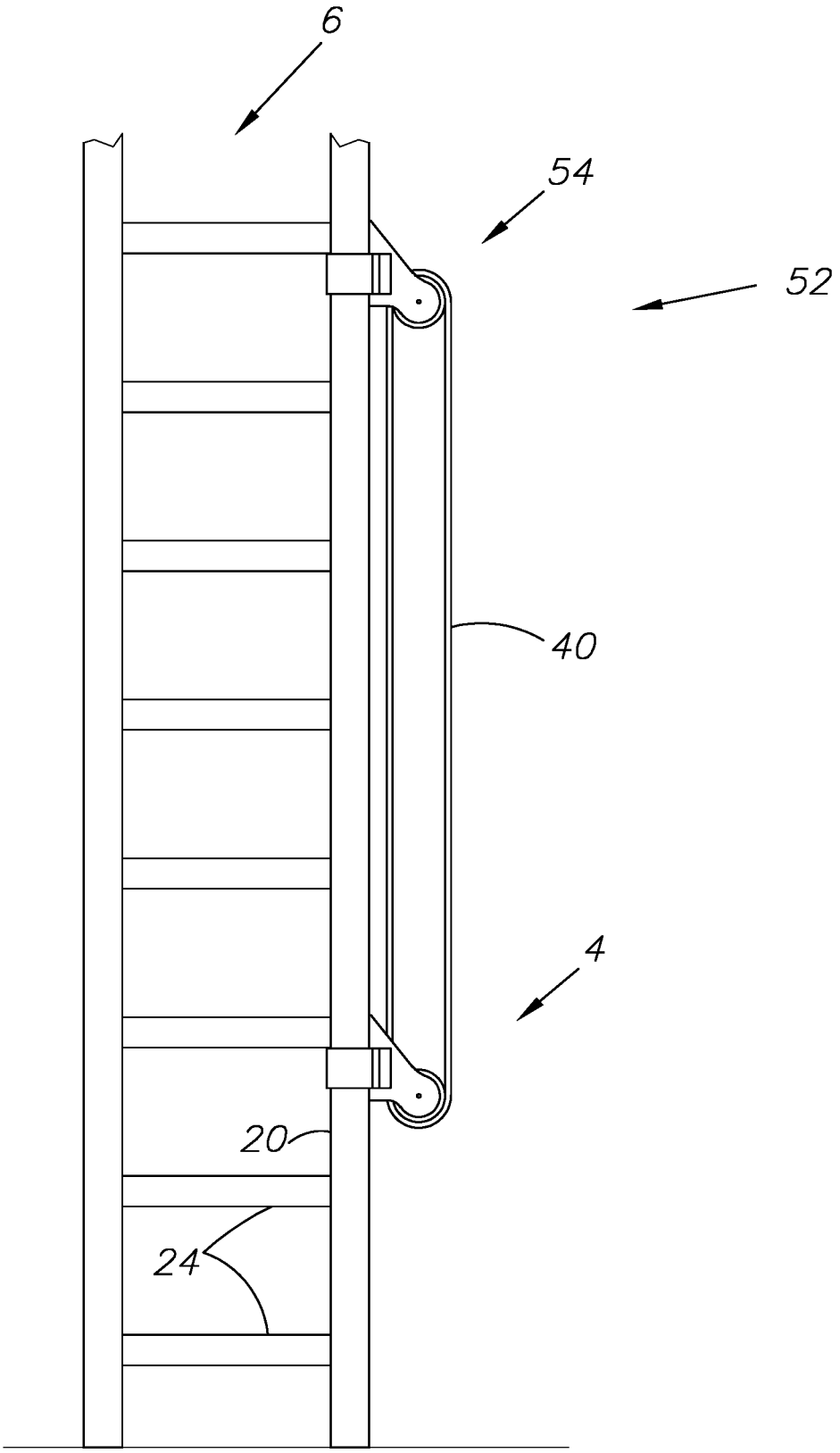
FIG. 12 is a side elevational view of an alternative embodiment of the present invention.

As shown in FIGS. 1-4, the present invention provides a ladder roller system 2 which includes a standard step ladder 6 or adjustable ladder having a pair of side rails 20 and a plurality of steps 24, and a roller element 4 which connects to the ladder 6 and allows it to be easily transported. The roller element includes a housing 8 which secures a roller wheel 10 about a roller axle 18. A pair of side clamps 16 connect the housing 8 to the side rails 20 of the ladder. A removable plug 14 can be inserted into the void 22 within the steps 24 of the ladder for additional security. A cap 12 covers a receiver for removing the plug 14. The roller wheel 10 may include a groove 38 which allows the roller to double function as a pulley system as shown in FIG. 12.

Figure 1:
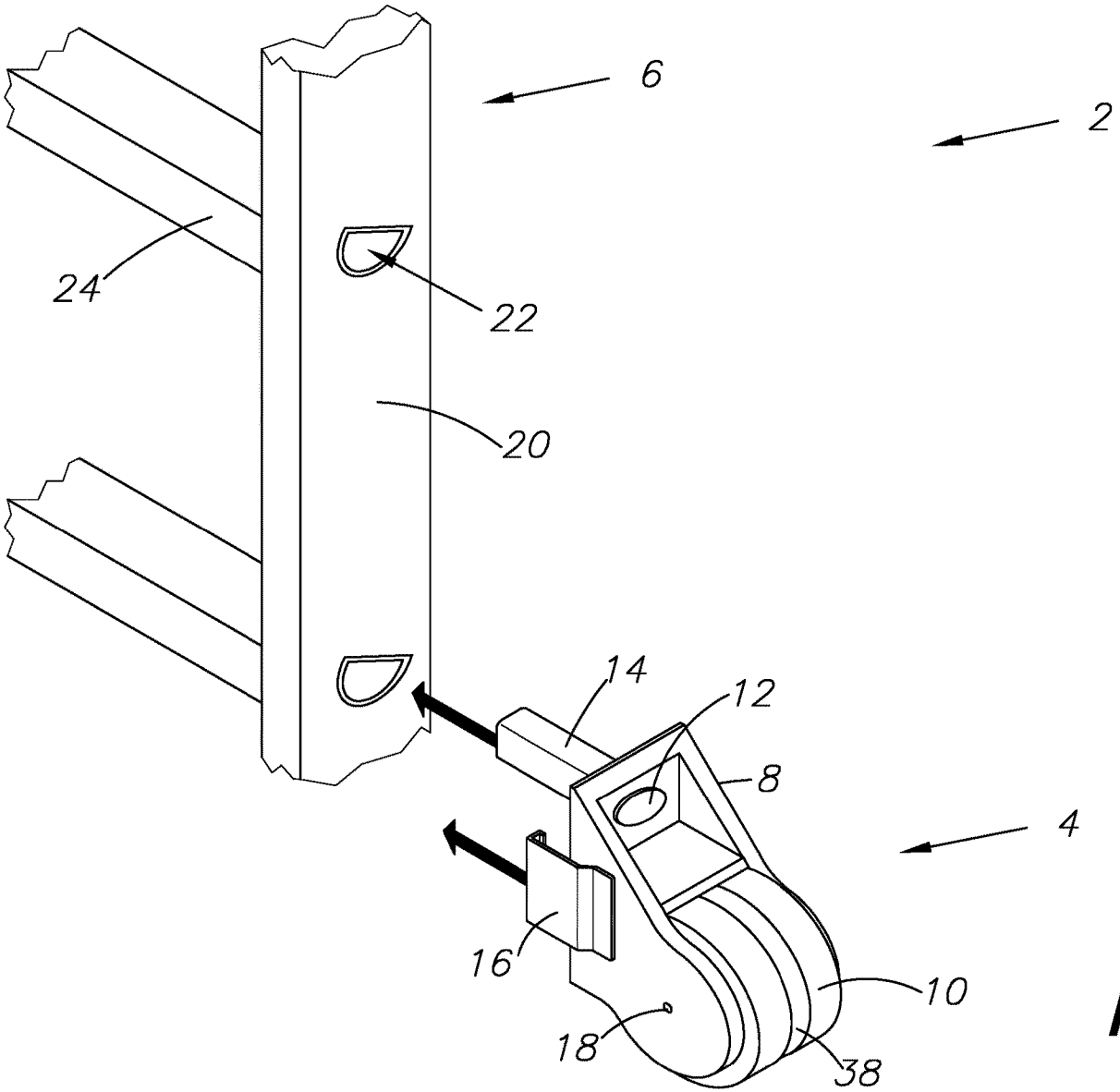
FIG. 1 is a three-dimensional isometric view showing a preferred embodiment of the present invention being installed into a typical environment of a ladder.
Figure 2:
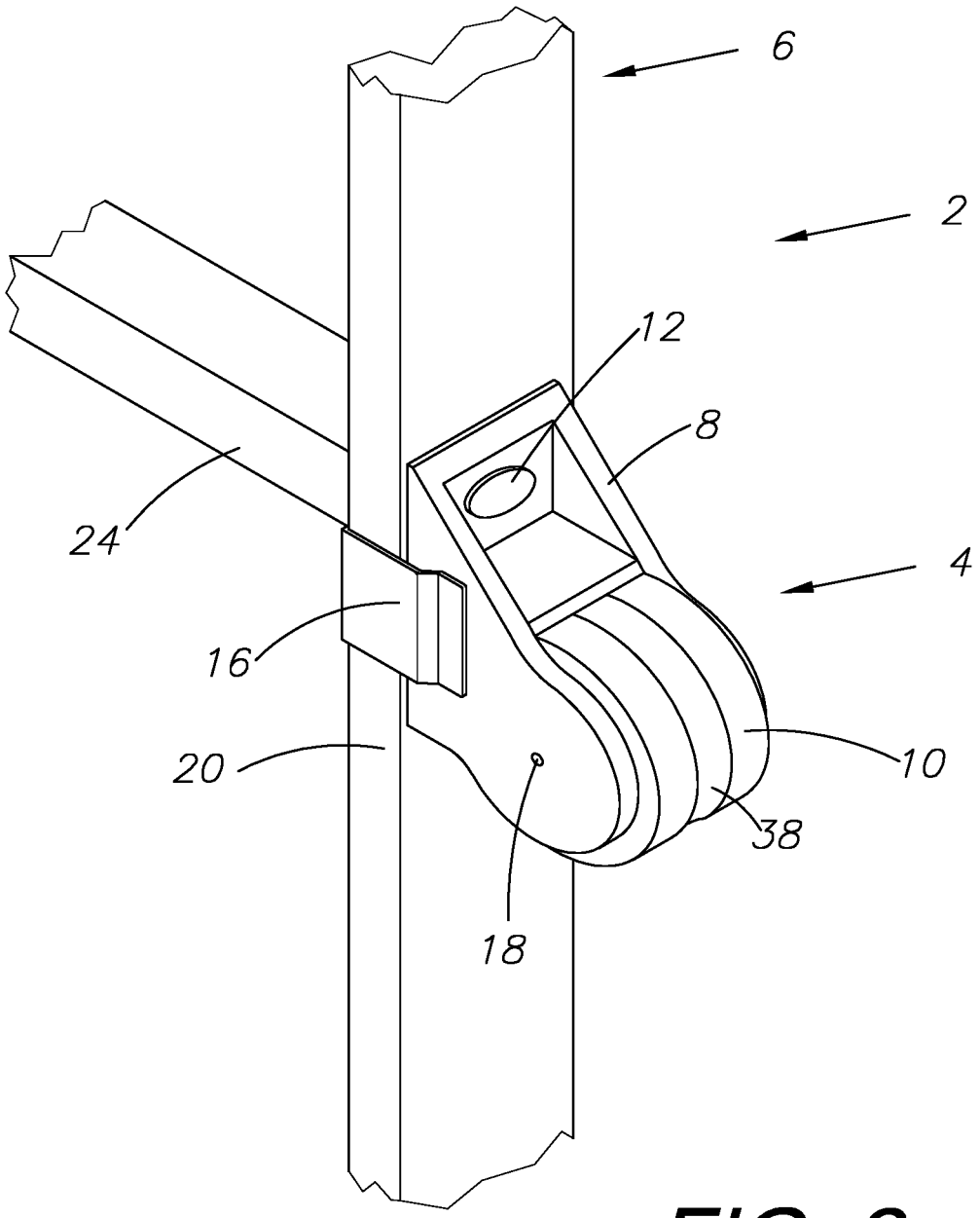
FIG. 2 is a three-dimensional isometric view thereof shown in an installed orientation.
Figure 4:
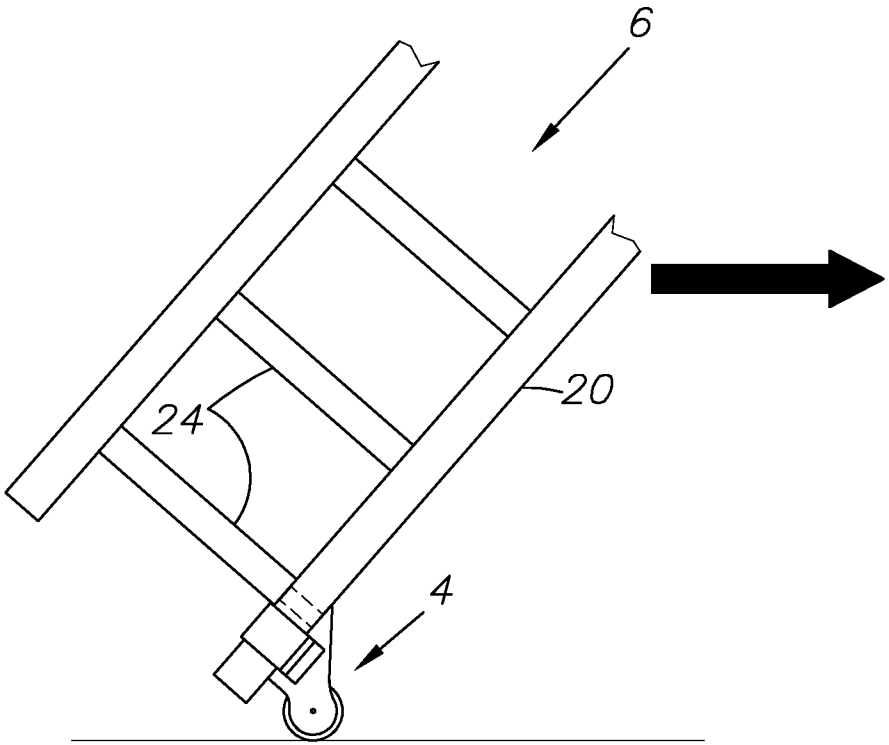
FIG. 4 is a front elevational view thereof shown in a tipped orientation to allow use of the roller wheel element of the preferred embodiment of the present invention.
Figure 3:
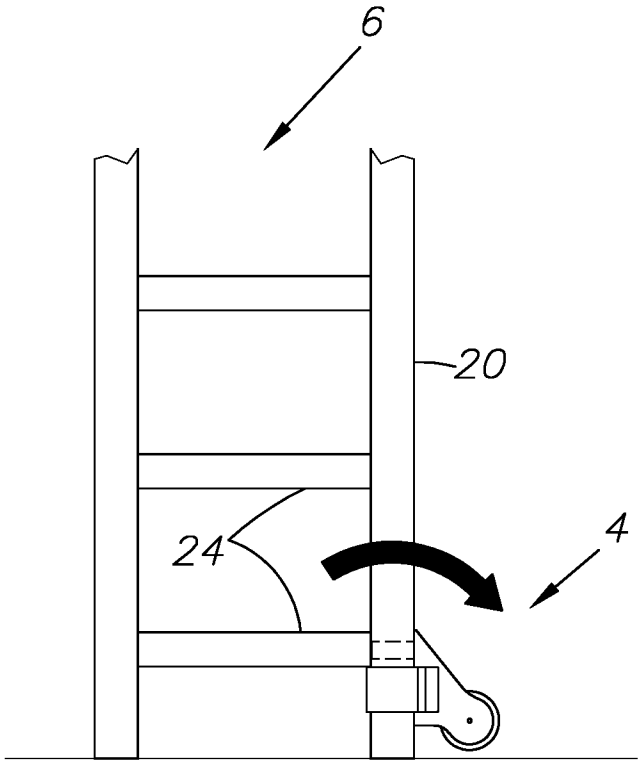
FIG. 3 is a front elevational view thereof.
Figure 5:
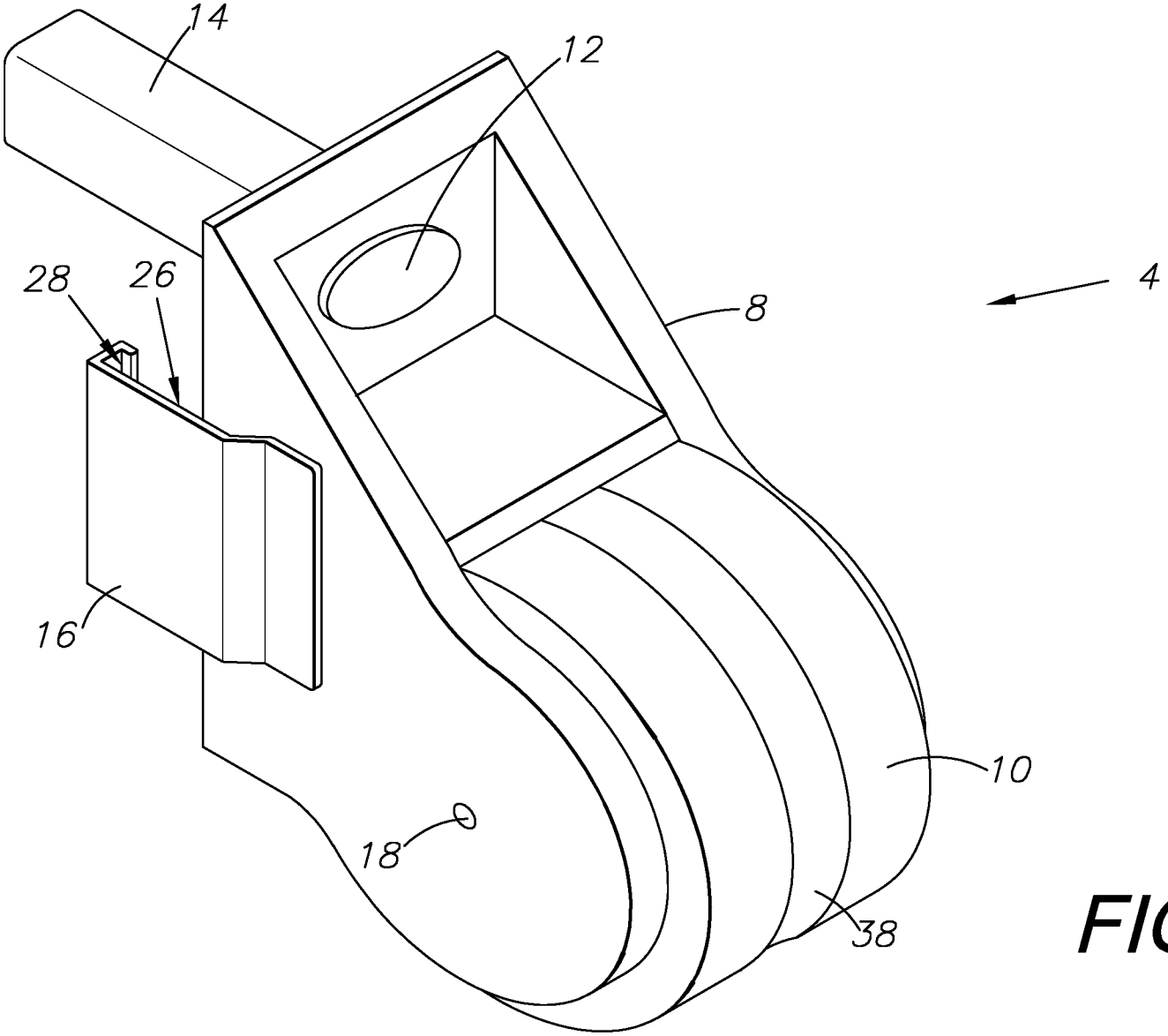
FIG. 5 is a three-dimensional isometric view of the preferred embodiment of the present invention.

FIG. 3 shows how the ladder 6 appears when upright and in use and including the roller element 4. FIG. 4 shows how the ladder 6 is tipped to the roller wheel 10 of the roller element 4, and then can be moved and repositioned with ease.

Figure 6:
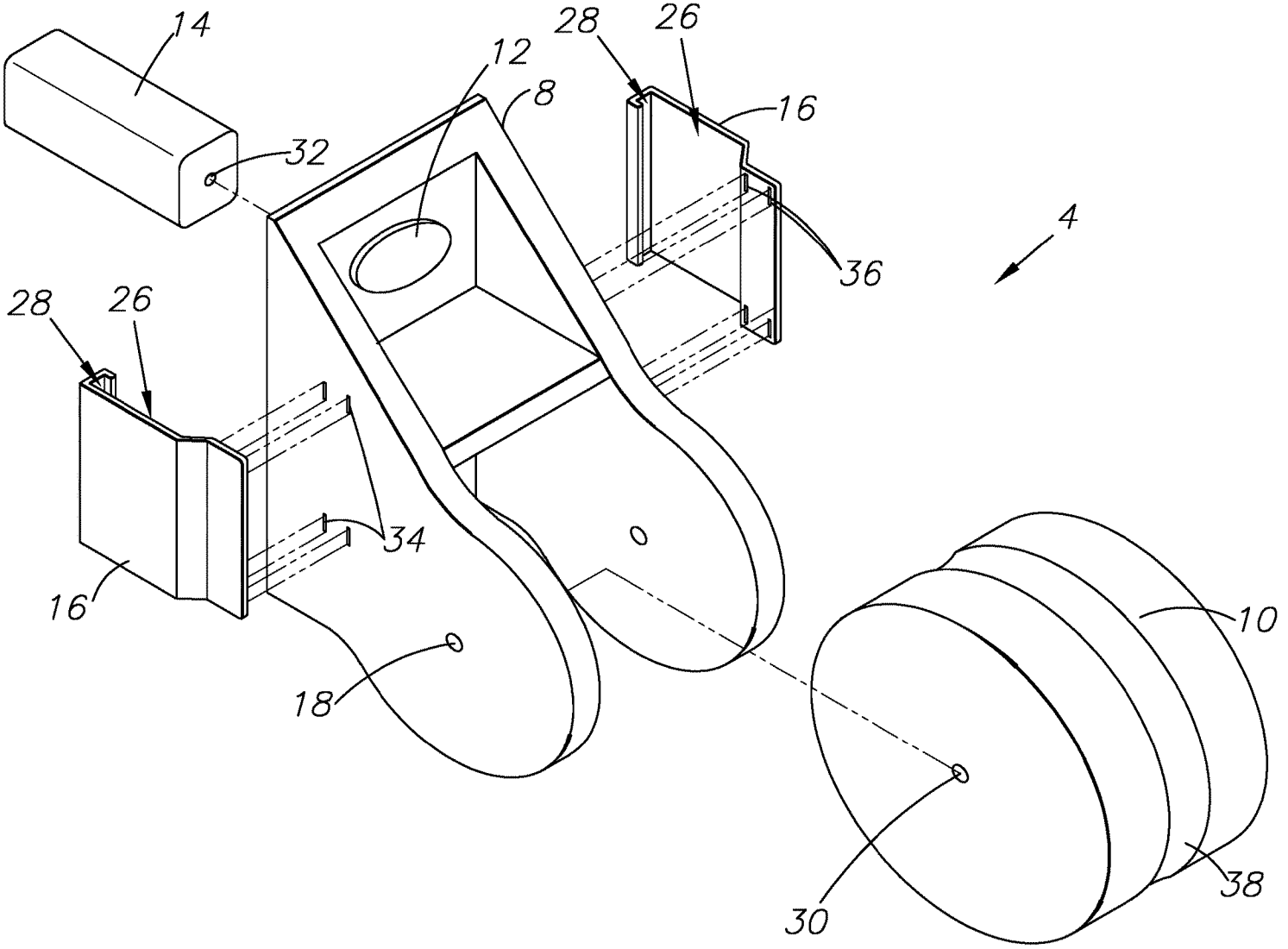
FIG. 6 is an exploded isometric view thereof.
Figure 7:
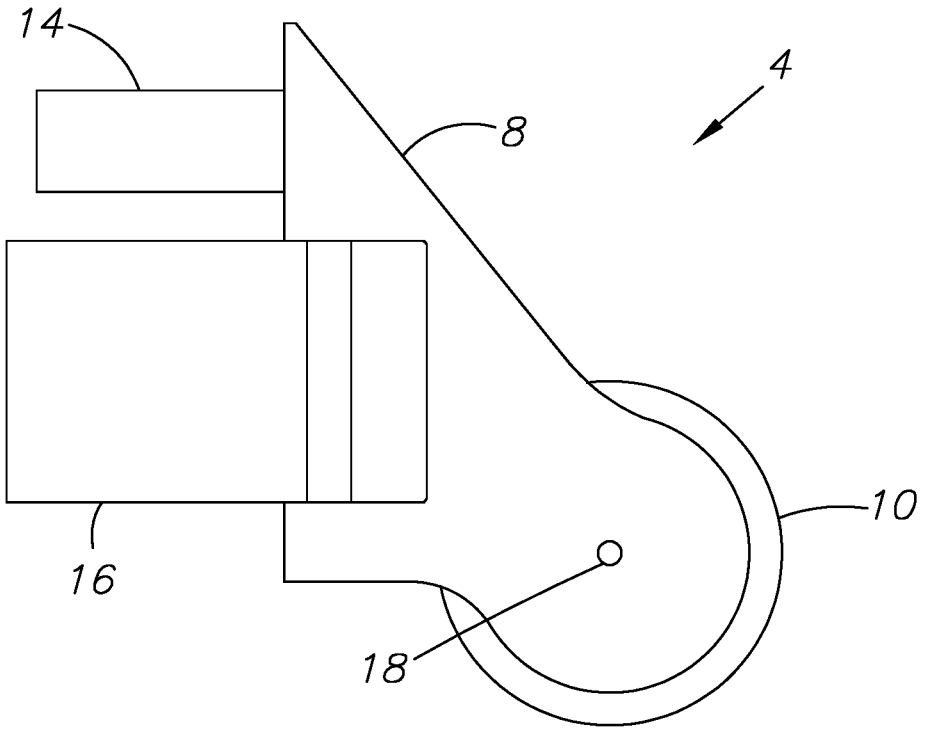
FIG. 7 is a side elevational view thereof.
Figure 8:
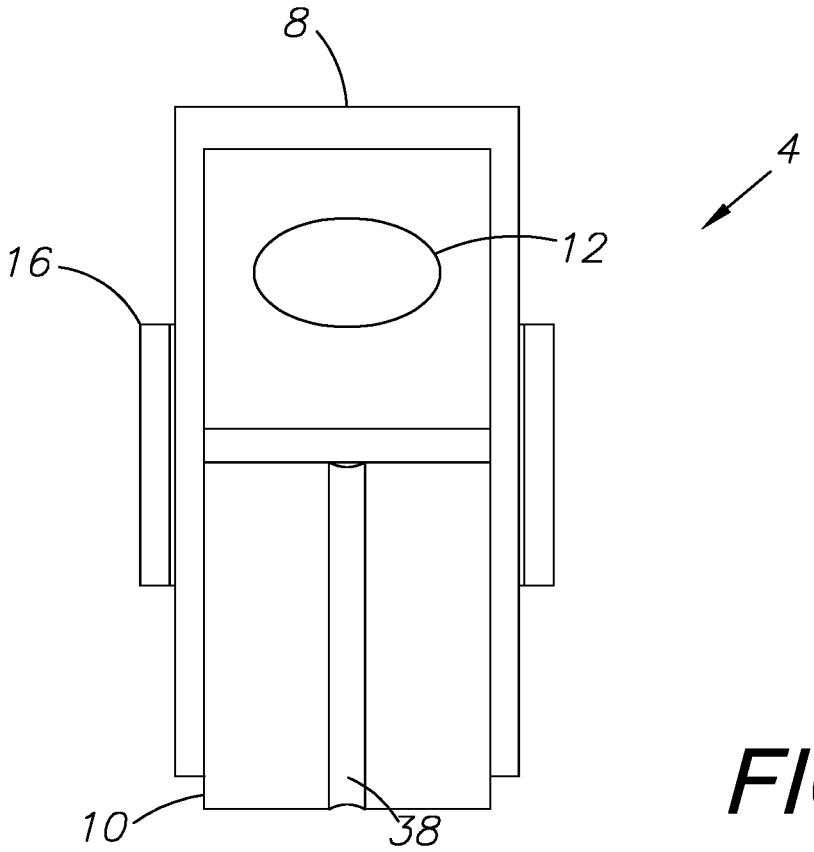
FIG. 8 is a front elevational view thereof.
Figure 9:
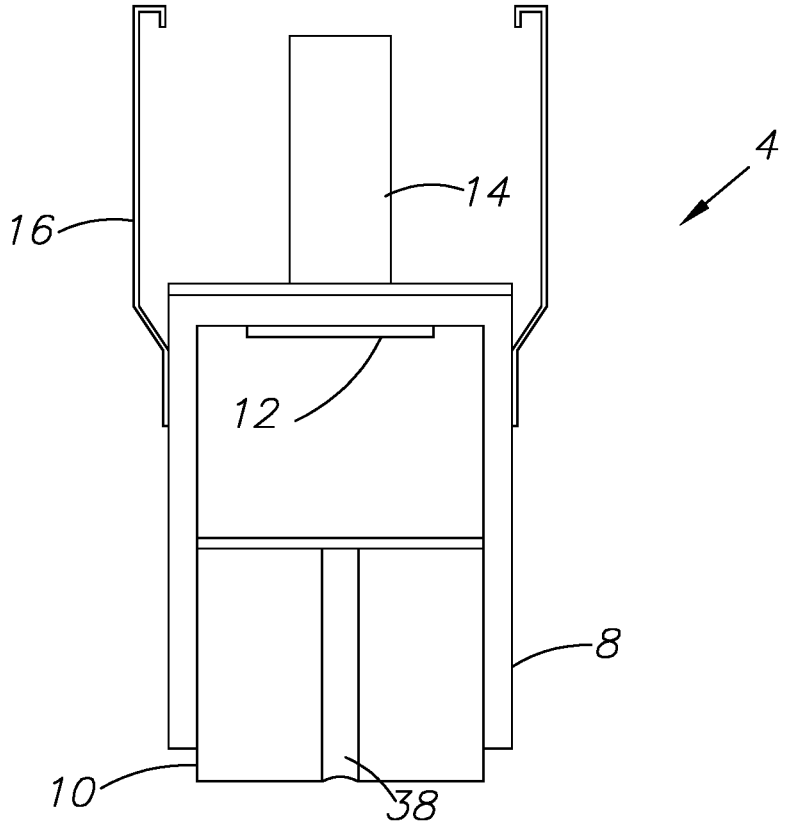
FIG. 9 is a top plan view thereof.
Figure 10:
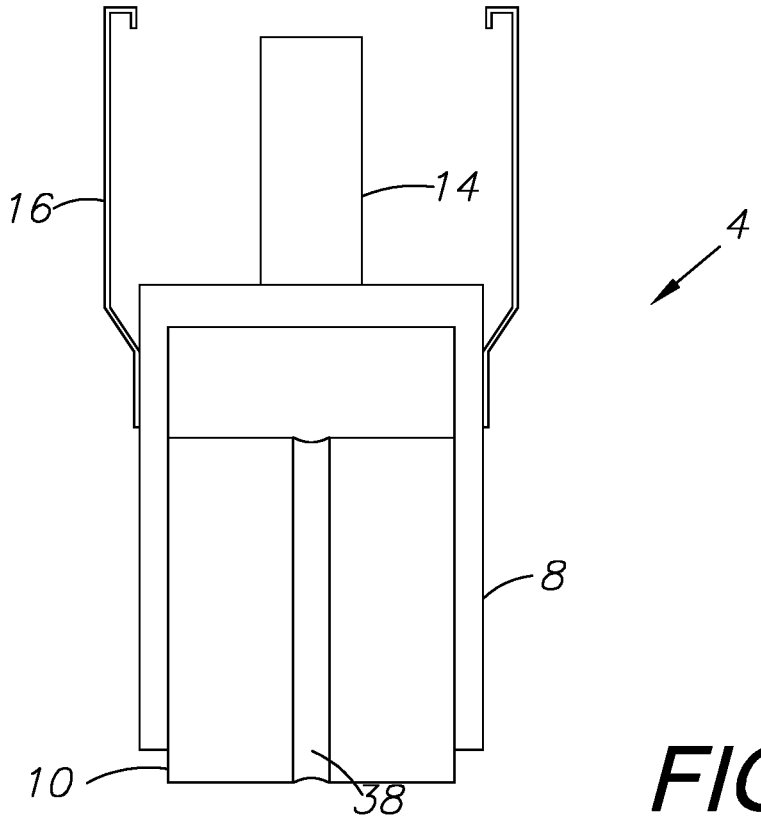
FIG. 10 is a bottom plan view thereof.
Figure 11:
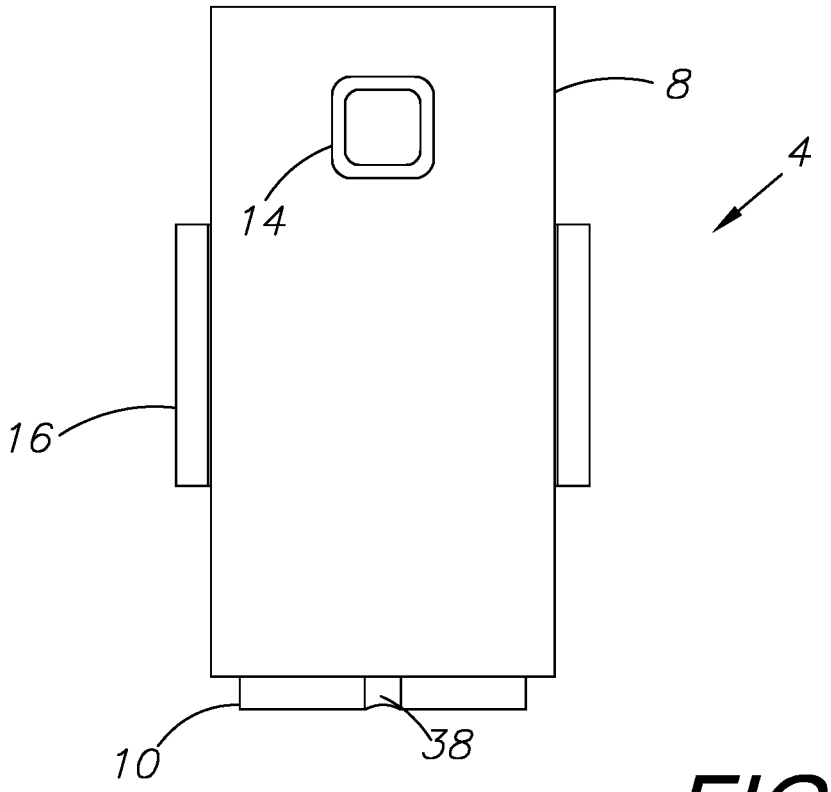
FIG. 11 is a rear elevational view thereof.

FIGS. 5-11 show the roller element 4 in more detail. The side latches 16 include a side space 26 for receiving the sidewall of the ladder's rails 20, and an end space 28 for receiving the leading edge of the rail 20 to optimally secure the roller element 4 to the rail 20. FIG. 6 shows how the side latches 16 could be removable using receivers 34 located on the housing 8, and connectors 36 located on the latches 16. Similarly the plug 14 includes a mountable receiver 32 for connecting to the housing 8.

The plug 14 is ideally shaped to fit within the typical half-moon shaped opening 26 within the ladder. It tightens within the space to help secure the roller element 4 to the ladder.

As shown in FIG. 6, the roller wheel 10 includes a central pivot point 30 which may be affixed to the hosing 8 using an axle or nodule located along the point labeled 18 on the housing 8.

The housing 8 is ideally made of a highly reflective material. It can be used to replace a flag when storing and hauling the ladder in a truck or other vehicle. The flag is necessary, and sometimes required by law, when the ladder extends out from a vehicle. The highly reflective colored material of the housing would render the flag unnecessary.

III. Alternative Embodiment Pulley Assembly 52

FIG. 12 shows how a roller element 4 of the previous embodiment could also be used as a pulley system 52 in combination with the same ladder 6. One roller element 4 could be used and a rope 40 could be guided along the groove 38 of the one roller element 4. As shown in FIG. 12, however, a second roller element 54 could also be used to increase the versatility of the pulley system 52. Additional roller elements could also be used.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A ladder roller system comprising:

a roller device configured for interfacing with a side rail of a ladder;

said roller device comprising a pair of side latches configured for engaging with said side rail of said ladder and holding said roller device in place against said side rail;

said roller device further comprising a roller wheel pivotally connected within a housing of said roller device, said roller wheel configured for providing rolling movement to said ladder when said ladder is tipped and dragged;

said roller wheel comprising a first groove configured for receiving a pulley cord;

said roller device further configured for operating as a pulley assembly;

a second roller device affixed to said ladder side rail, said second roller device comprising a second roller wheel; and said second roller wheel comprising a second groove, said pulley cord connecting to said second groove.

2. The ladder roller system of claim 1, further comprising:

said ladder comprising a void within a step affixed to said side rail;

said roller device comprising a plug configured to be inserted into said void; and said plug configured for securing said roller device to said ladder.

3. The ladder roller system of claim 1, further comprising:

each one of said pair of side latches comprising a first void for receiving a side wall of said side rail; and each one of said pair of side latches further comprising a second void for receiving an edge of said side rail.

4. A roller device comprising:

a housing comprising a roller wheel receiver and a pair of side latches;

said pair of latches configured for connecting said housing to a side rail of a ladder;

said roller wheel receiver configured to receive a roller wheel configured for carrying and rolling said ladder;

said roller wheel comprising a first groove configured for receiving a pulley cord;

said roller device further configured for operating as a pulley assembly;

a second roller device affixed to said ladder side rail, said second roller device comprising a second roller wheel; and said second roller wheel comprising a second groove, said pulley cord connecting to said second groove.

5. The ladder roller system of claim 4, further comprising:

a plug affixed to a rear face of said housing, said plug configured to be inserted into a void within a step of said ladder; and said plug configured for securing said roller device to said ladder.

6. The ladder roller system of claim 4, further comprising:

each one of said pair of side latches comprising a first void for receiving a side wall of said side rail; and each one of said pair of side latches further comprising a second void for receiving an edge of said side rail.

7. The ladder roller system of claim 4, wherein said roller device comprises a reflective colored material.

8. A method of operating the ladder roller system of claim 1, the method comprising the steps: placing the ladder upright into a location, said ladder comprising the side rail and an other side rail and a plurality of steps; connecting the pair of side latches of the roller device to one of said pair of side rails, said roller device further comprising the housing and the roller wheel; tilting said ladder to an angle such that said roller wheel contacts a ground surface; pulling said ladder such that said ladder is rolled along said ground surface by said roller wheel; and redeploying and placing said ladder into a second location by tilting said ladder upright.

* * * * *